US009520643B2

(12) United States Patent
Shiu et al.

(10) Patent No.: US 9,520,643 B2
(45) Date of Patent: Dec. 13, 2016

(54) ELECTRONIC DEVICE WITH FOAM ANTENNA CARRIER

(71) Applicant: Apple Inc., Cupertino, CA (US)

(72) Inventors: Boon W. Shiu, San Jose, CA (US); Chun-Lung Chen, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 544 days.

(21) Appl. No.: 13/860,437

(22) Filed: Apr. 10, 2013

(65) Prior Publication Data

US 2014/0306845 A1 Oct. 16, 2014

(51) Int. Cl.

*H01Q 1/38* (2006.01)
*H01Q 1/24* (2006.01)
*H01Q 9/04* (2006.01)

(52) U.S. Cl.

CPC ..... *H01Q 1/38* (2013.01); *H01Q 1/243* (2013.01); *H01Q 9/0421* (2013.01); *Y10T 29/49016* (2015.01)

(58) Field of Classification Search

CPC ..... H01Q 1/38
USPC ..... 343/700 MS, 702, 893, 905
See application file for complete search history.

(56) References Cited

U.S. PATENT DOCUMENTS 4,159,414 A * 6/1979 Suh ..... H05K 3/105 219/121.17
4,752,499 A * 6/1988 Enomoto ..... H01R 4/04 427/306
5,733,639 A * 3/1998 Gosselin ..... 428/209
5,795,618 A * 8/1998 Asai ..... C08G 59/18 427/306
6,124,831 A 9/2000 Rutkowski et al.
6,703,114 B1 * 3/2004 Guiles et al. ..... 428/209
6,937,192 B2 8/2005 Mendolia et al.
6,947,008 B2 9/2005 Tillery et al.
(Continued)

FOREIGN PATENT DOCUMENTS

EP 1588455 10/2005
WO 2004070878 8/2004

OTHER PUBLICATIONS

Google search, Laser direct structuring powder with polymer and metal, No Date, pp. 1-2.*
(Continued)

*Primary Examiner* — Huedung Mancuso
(74) *Attorney, Agent, or Firm* — Treyz Law Group, P.C.; G. Victor Treyz; Joseph F. Guihan

(57) ABSTRACT

Electronic devices may include radio-frequency transceiver circuitry and antenna structures. The antenna structures may include a dielectric carrier such as a foam carrier. The foam carrier may be formed from a material that can withstand elevated temperatures. Metal traces for antennas can be formed on the foam carrier by selectively activating areas on a powder coating with a laser and plating the laser-activated areas. Metal for the antennas may also be formed by attaching layers such as flexible printed circuit layers and metal foil layers to the foam carrier. Solder may be used to attach a coaxial cable or other transmission line, electrical components, and other electrical structures to the metal antenna structures on the foam carrier. The foam carrier may be formed from open cell or closed cell foam. The surface of the foam may be smoothed to facilitate formation of metal antenna structures.

10 Claims, 8 Drawing Sheets

(56) References Cited

U.S. PATENT DOCUMENTS

| | | | | |
|---|---|---|---|---|
| 8,730,124 | B2 | 5/2014 | Behrens et al. | |
| 9,007,265 | B2 * | 4/2015 | Das | 343/700 MS |
| 2002/0094433 | A1 * | 7/2002 | Hug | B32B 5/18 428/319.1 |
| 2003/0174099 | A1 * | 9/2003 | Bauer et al. | 343/893 |
| 2007/0278105 | A1 * | 12/2007 | Ettel | C25D 1/08 205/272 |
| 2009/0303135 | A1 | 12/2009 | Reed et al. | |
| 2011/0301289 | A1 * | 12/2011 | Amiel | B01J 31/2213 524/601 |
| 2012/0274535 | A1 * | 11/2012 | Deavours | 343/848 |
| 2013/0021718 | A1 * | 1/2013 | Yager | C01B 31/0453 361/502 |
| 2013/0068968 | A1 * | 3/2013 | Daniel | B23K 26/0084 250/492.1 |
| 2013/0088406 | A1 | 4/2013 | Hamada et al. | |
| 2013/0190607 | A1 | 7/2013 | Biber et al. | |
| 2013/0335275 | A1 | 12/2013 | Sanford et al. | |
| 2014/0226291 | A1 | 8/2014 | Gibbs et al. | |
| 2014/0272277 | A1 * | 9/2014 | Schaedler | C09D 1/00 428/116 |
| 2015/0274965 | A1 * | 10/2015 | Nair | H05K 1/0373 428/220 |

OTHER PUBLICATIONS

Google search, Laser Direct Structuring Technology, No Date, pp. 1-2.*

LPKF Laser and Electronics, MacDermid develops firmer, faster electroplating for LDS, No Date, p. 1.*

Google search, Electroless plating powder, No Date, pp. 1-2.*

Jiang et al., U.S. Appl. No. 13/864,968, filed Apr. 17, 2013.

Guterman et al., U.S. Appl. No. 13/490,356, filed Jun. 6, 2012.

Shiu et al., U.S. Appl. No. 13/250,784, filed Sep. 30, 2011.

* cited by examiner

ELECTRONIC DEVICE WITH FOAM ANTENNA CARRIER

BACKGROUND

This relates generally to electronic devices, and more particularly, to antennas for electronic devices.

Antennas are often formed by depositing metal traces on plastic carriers. Patterned metal traces may, for example, be formed using laser-based techniques. With this approach, a laser is used to activate selected areas on a plastic carrier. Following laser activation, electroplating is used to grow metal traces in the activated areas.

The plastic carriers that are used for forming antennas in this way may have dielectric properties that give rise to larger losses than desired. If care is not taken, selection of an inappropriate plastic carrier for an antenna may cause the antenna to experience undesired performance degradation.

It would therefore be desirable to be able to provide electronic devices with improved antenna structures.

SUMMARY

Electronic devices may include radio-frequency transceiver circuitry and antenna structures. The antenna structures may include a dielectric carrier such as a foam carrier. The use of the foam carrier may help optimize antenna performance. The foam carrier may be formed from a material that can withstand elevated temperatures to facilitate formation of patterned metal on the carrier and attachment of conductive structures using solder.

Metal traces for antennas can be formed on the foam carrier by selectively activating areas on a powder coating with a laser and plating the laser-activated areas. The powder coating may be applied electrostatically and baked prior to exposure to laser light. After laser light has been selectively applied to the powder coating, an electrochemical deposition process may be used to grow metal traces in the laser-activated areas without growing metal in the areas that were not exposed to laser light.

Metal for the antennas may also be formed by attaching layers such as flexible printed circuit layers and metal foil layers to the foam carrier. These layers may be attached to the foam carrier as part of a molding process or following machining or other shaping operations to form a foam carrier of a desired shape.

Solder may be used to attach a coaxial cable or other transmission line to the metal antenna structures on the foam carrier. Electrical components such as packaged electrical devices may also be soldered to the metal structures on the foam carrier. An oven may be used to reflow solder paste or soldering operations may be performed using other equipment such as a hot bar tool.

The foam carrier may be formed from open cell or closed cell foam. The surface of the foam may be smoothed to facilitate formation of metal antenna structures. A smooth surface may be created by applying a smoothing coating to the carrier or by applying a heat treatment or other smoothing treatment to the carrier.

Further features of the invention, its nature and various advantages will be more apparent from the accompanying drawings and the following detailed description of the preferred embodiments.

DETAILED DESCRIPTION

Figure 1:
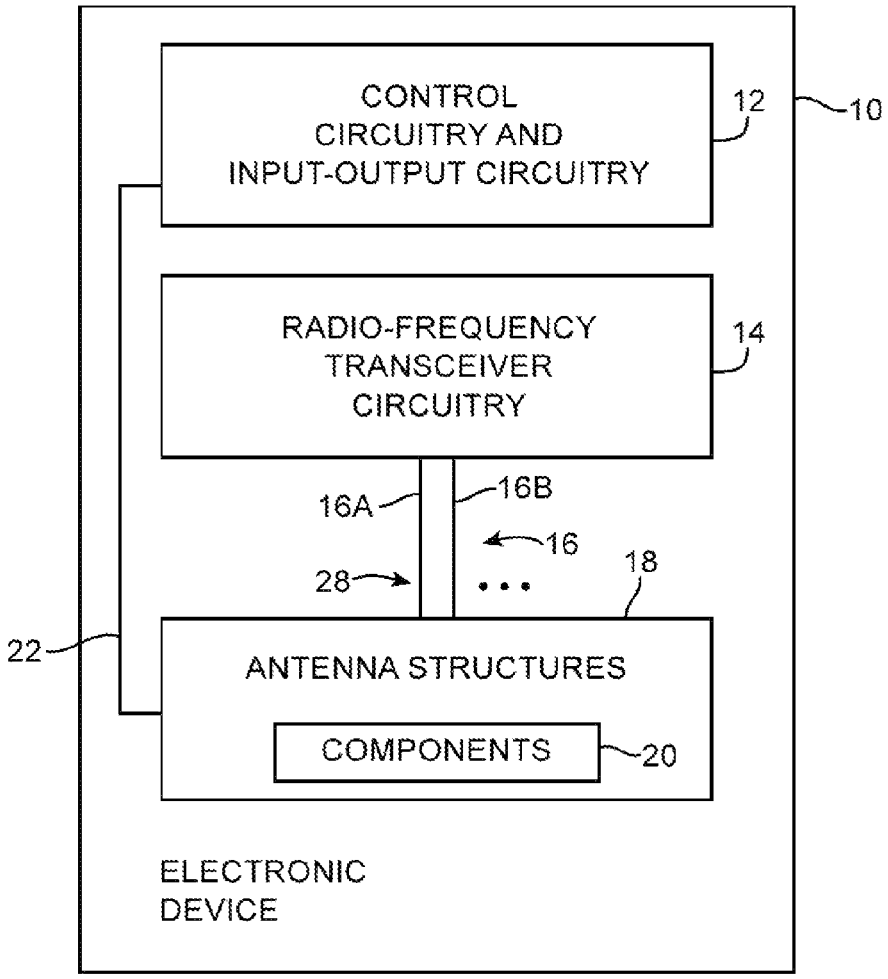
FIG. 1 is a schematic diagram of an illustrative electronic device with antenna structures in accordance with an embodiment of the present invention.

Electronic devices such as electronic device 10 of FIG. 1 may be provided with antenna structures such as antenna structures 18. Antenna structures 18 may include one or more antennas. The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from patterned metal on dielectric carrier structures. The patterned metal may be formed using laser-based metal deposition techniques or by attaching layers such as layers of metal foil or printed circuit structures to the dielectric carrier structures. Other conductive structures may also be used in forming antenna structures 18 if desired (e.g., conductive housing structures, parts of electronic components, internal support structures, brackets, metal plates, and other conductive internal structures, portions of displays and touch sensors, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing. The housing, which may sometimes be referred to as a case, may be formed of plastic, glass, ceramics, fiber composites, metal (e.g., stainless steel, aluminum, etc.), other suitable materials, or a combination of these materials. In some situations, parts of the housing may be formed from dielectric or other low-conductivity material. In other situations, the housing for device 10 or at least some of the structures that make up the housing may be formed from metal elements.

Device 10 may, if desired, have a display. The display may be a touch screen that incorporates capacitive touch electrodes. The display may include image pixels formed from light-emitting diodes (LEDs), organic LEDs (OLEDs), plasma cells, electrowetting pixels, electrophoretic pixels, liquid crystal display (LCD) components, or other suitable image pixel structures.

In general, device 10 may include any suitable number of antennas in antenna structures 18 (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations.

Antennas in device 10 such as antenna structures 18 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

As shown in FIG. 1, electronic device 10 may include control circuitry and input-output circuitry 12. Circuitry 12 may include storage and processing circuitry. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 12 may be used to control the operation of device 10. The processing circuitry may be based on one or more microprocessors, microcontrollers, digital signal processors, baseband processors, power management units, audio codec chips, application specific integrated circuits, etc.

Control circuitry 12 may be used to run software on device 10, such as internet browsing applications, voice-over-internet-protocol (VOIP) telephone call applications, email applications, media playback applications, operating system functions, etc. To support interactions with external equipment, control circuitry 12 may be used in implementing communications protocols. Communications protocols that may be implemented using control circuitry 12 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 12 may be configured to implement control algorithms that control the use of antennas in device 10. For example, circuitry 12 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 12 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc.

In performing these control operations, circuitry 12 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry in circuitry 12 may be used to allow data to be supplied to device 10 and to allow data to be provided from device 10 to external devices. The input-output circuitry may include input-output devices. The input-output devices may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices and may receive status information and other output from device 10 using the output resources of input-output devices.

Wireless communications circuitry such as radio-frequency transceiver circuitry 14 may be formed from one or more integrated circuits and may include power amplifier circuitry, low-noise input amplifiers, passive RF components, one or more antennas, filters, duplexers, and other circuitry for handling RF wireless signals.

Circuitry 14 may include satellite navigation system receiver circuitry such as Global Positioning System (GPS) receiver circuitry (e.g., for receiving satellite positioning signals at 1575 MHz) or satellite navigation system receiver circuitry associated with other satellite navigation systems. Wireless local area network transceiver circuitry in circuitry 14 may handle 2.4 GHz and 5 GHz bands for WiFi® (IEEE 802.11) communications and may handle the 2.4 GHz Bluetooth® communications band. Circuitry 14 may include cellular telephone transceiver circuitry for handling wireless communications in cellular telephone bands such as bands in frequency ranges of about 700 MHz to about 2700 MHz or bands at higher or lower frequencies. Wireless communications circuitry such as radio-frequency transceiver circuitry 14 can include circuitry for other short-range and long-range wireless links if desired. For example, circuitry 14 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

The wireless communications circuitry of device 10 may include antenna structures 18. Antenna structures 18 may be formed using any suitable antenna types. For example, antenna structures 18 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

Antenna structures in device 10 may be provided with one or more antenna feeds, fixed and/or adjustable components such as components 20, and optional parasitic antenna resonating elements so that the antenna structures cover desired communications bands. Components 20 may include integrated circuits, discrete components such as capacitors, inductors, and resistors, switches, circuitry for filtering signals, impedance matching circuitry, tunable circuits based on adjustable capacitors, adjustable inductors, and other adjustable circuits, components mounted in surface mount technology packages, and other electrical components.

As shown in FIG. 1, antenna structures 18 may be coupled to wireless circuitry such as transceiver circuitry 14 and other circuitry using transmission line structures such as transmission line 16. Transmission line 16 may have positive signal path 16A and ground signal path 16B. Paths 16A and 16B may be formed from metal traces on rigid printed circuit boards, may be formed from metal traces on flexible printed circuits, may be formed on dielectric support structures such as plastic, glass, and ceramic members, may be formed as part of a cable, or may be formed from other conductive signal lines. Transmission line 16 may be formed using one or more microstrip transmission lines, stripline transmission lines, edge coupled microstrip transmission lines, edge coupled stripline transmission lines, coaxial cables, or other suitable transmission line structures. Circuits such as impedance mating circuits, filters, switches, duplexers, diplexers, and other circuitry may, if desired, be interposed in transmission line 16 and/or formed using components 20 such as components associated with antenna structures 18.

Figure 2:
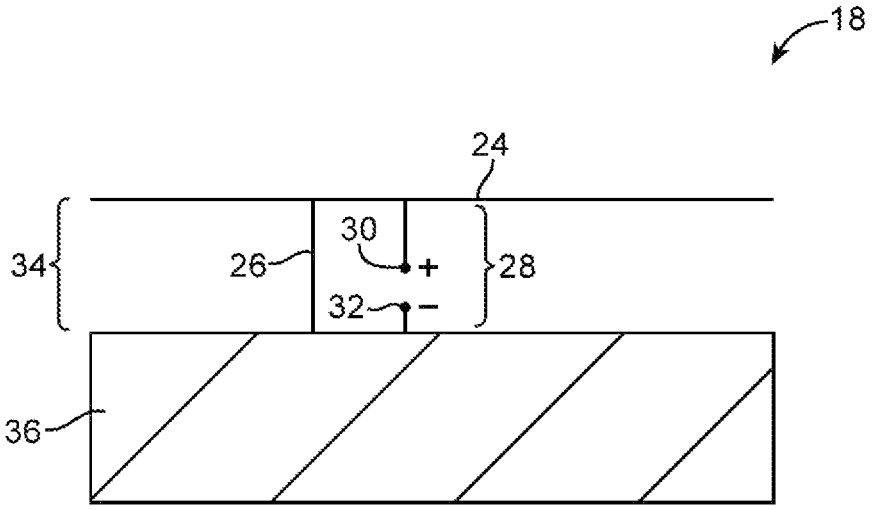
FIG. 2 is a diagram of an illustrative antenna in accordance with an embodiment of the present invention.

Transmission line 16 may be coupled to an antenna feed for an antenna in antenna structures 18 such as feed 28. FIG. 2 is a diagram of an illustrative antenna 18 of the type that may be sued in device 10. As shown in FIG. 2, antenna feed 28, which may sometimes be referred to as an antenna port, may include positive antenna feed terminal 30 and ground antenna feed terminal 32. If desired, antenna 18 may have multiple feeds. The configuration of FIG. 2 in which antenna 18 has a single feed is merely illustrative.

Antenna 18 may include an antenna resonating element such as antenna resonating element 34 and an antenna ground such as antenna ground 36. Return path 26, which may also be referred to as a short circuit path, may be used to couple main arm 24 of antenna resonating element 34 to antenna ground 36. Antenna resonating element 34 may be an inverted-F antenna resonating element. Antenna ground 36 may be formed from metal traces on a dielectric carrier, metal housing structures, portions of an electronic component, or other metal structures. Return path 26 may be coupled between main arm 24 of inverted-F antenna resonating element 34 and antenna ground 36 in parallel with antenna feed path 28.

If desired, tunable components such as adjustable capacitors, adjustable inductors, filter circuitry, switches, impedance matching circuitry, duplexers, and other circuitry may be interposed within transmission line path 16 (i.e., between transceiver circuitry 14 and feed 28). Tunable components may also be formed within the structures of antenna 18 (see, e.g., components 20 of FIG. 1). For example, a tunable component may be formed within arm 24 or path 26, may be coupled to antenna resonating element 34, or may otherwise be incorporated in transmission line 16 and antenna 18.

If desired, antenna 18 may be implemented using a patch antenna, loop antenna, slot antenna, monopole antenna, a hybrid antenna that includes multiple types of antenna structures, or other metal structures. The example of FIG. 2 in which antenna 18 has been formed using an inverted-F antenna design is merely illustrative.

Figure 3:
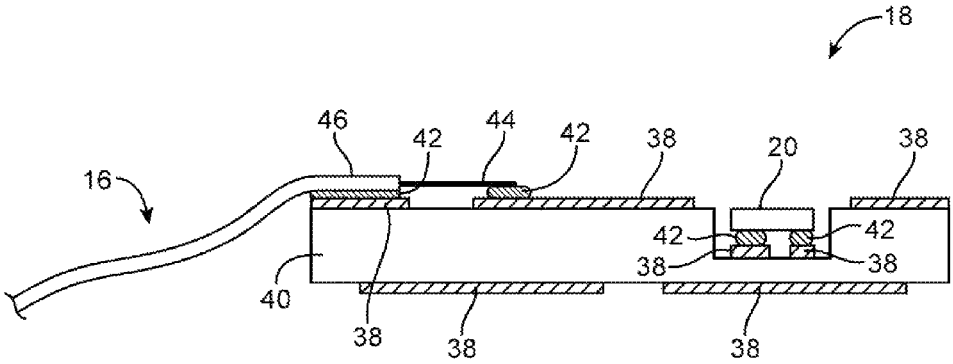
FIG. 3 is a cross-sectional side view of an illustrative antenna formed from metal traces on a dielectric carrier in accordance with an embodiment of the present invention.

Antenna 18 may be formed from metal antenna structures such as metal traces on a dielectric carrier. The metal traces may be formed directly on the surface of a dielectric carrier such as a foam carrier or patterned metal antenna structures may be formed from a piece of patterned foil or flexible printed circuit material that is attached to a foam carrier (as examples). FIG. 3 is a cross-sectional side view of antenna 18 in an illustrative configuration in which antenna 18 has patterned metal structures such as metal traces 38 that have been formed on the surface of dielectric carrier 40. Metal traces 38 may be formed from a metal such as copper, gold, aluminum, other metals, or combinations of these metals.

Foam carrier 40 may be formed from an open cell or closed cell foam. For example, carrier 40 may be formed from a foam material that has a dielectric constant of about 1.05 to 1.12. Solid plastics such as solid pieces of polycarbonate (PC), acrylonitrile butadiene styrene (ABS), or a PC/ABS blend, in contrast, may have larger dielectric constants (e.g., about 2.9), and may be more prone to dielectric losses than antennas formed from foam carriers such as foam carrier 40.

To ensure compatibility with efficient processes for depositing patterned metal traces 38, it may be desirable to form carrier 40 from a foam material that can withstand processing at elevated temperatures (e.g., temperatures above 150° C., temperatures above 175° C., temperatures above 190° C., etc.). As an example, it may be desirable to form carrier 40 from a foam material that can withstand temperatures of 190° C. for fifteen minutes (or other temperatures above 150° C.) to facilitate the formation of metal traces 38 (e.g., using processes that involve the baking of electrostatically applied powder coatings) and that can optionally withstand temperatures of 260° C. (or other temperatures above 200° C.) for reflowing solder. Examples of foam materials that may be used for forming carrier 40 include polymethacrylimide foam, polyamide foam, polyimide foam, and polyurethane foam. Other polymer foams may be used, if desired.

The ability to withstand soldering temperatures may allow components such as transmission line cable 16 and electrical component 20 to be soldered to traces 38 using solder 42. For example, transmission line 16 may be a coaxial cable having a center conductor such as center conductor 44 that is soldered to one of metal traces 38 using solder 42 and having an outer ground conductor such as ground conductor 46 that is soldered to one of metal traces 38 using solder 42. Component 20, which may be an integrated circuit, a packaged adjustable or fixed circuit based on one or more inductors, capacitors, and resistors, or other circuitry, or a flexible printed circuit with traces may also be soldered to metal traces 38 using solder 42.

Figure 4:
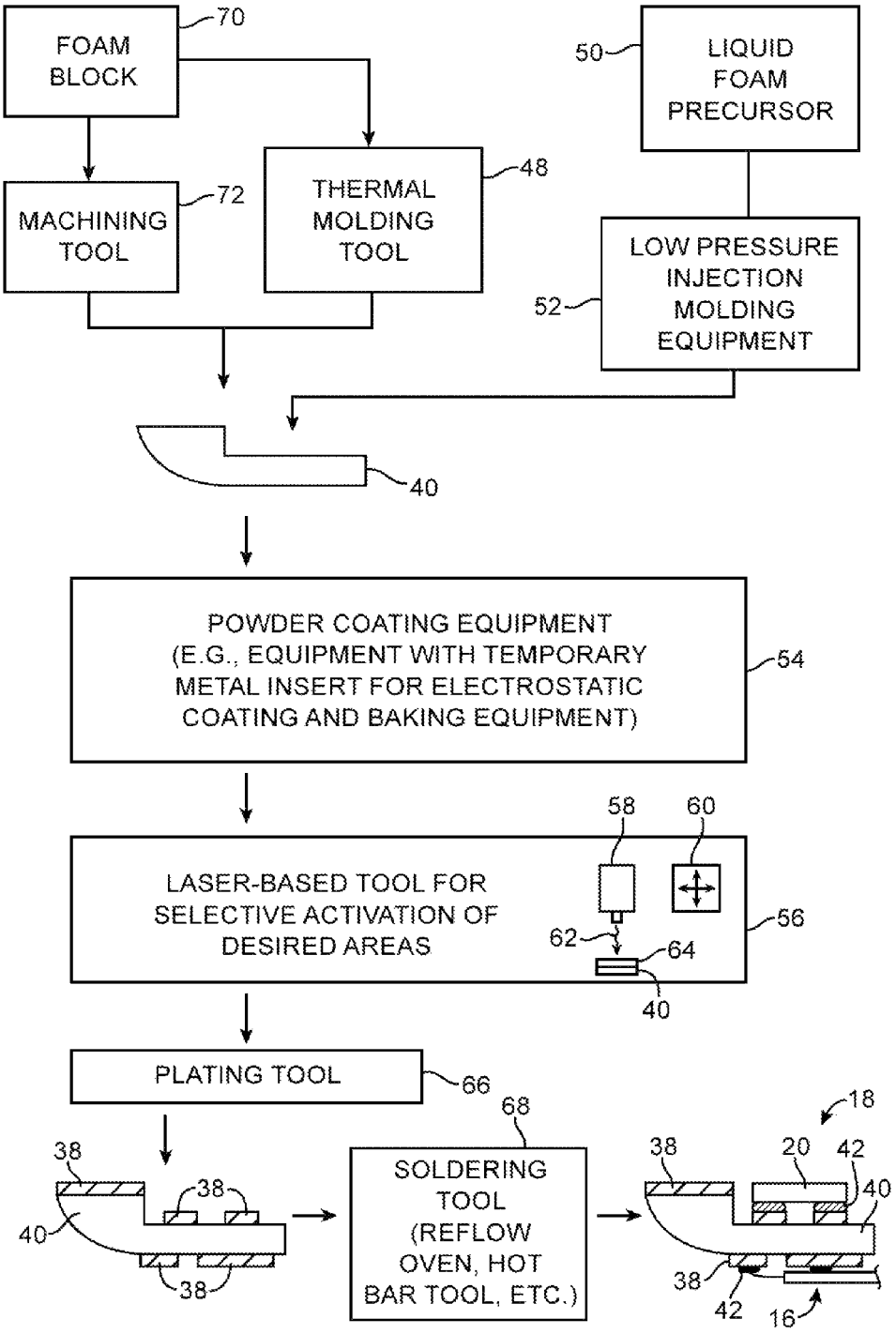
FIG. 4 is a diagram showing equipment and operations involved in forming antenna structures in accordance with an embodiment of the present invention.

FIG. 4 is a diagram showing how antenna 18 may be formed from a foam carrier. Foam material such as foam block 70 may be machined using machining tool 72 to produce foam carrier 40 in a desired shape. Machining tool 72 may be a computer numerical control (CNC) machine tool or other equipment that uses computer-controlled drills, saws, milling bits, or other equipment to shape foam 70 into carrier 40. If desired, foam 70 may be molded in a heated press such as thermal molding tool 48 to form carrier 40. Foam carrier 40 may also be formed by introducing liquid foam precursor material 50 into a mold civility in low-pressure injection molding equipment 52.

After forming foam carrier 40, patterned metal traces 38 may be deposited on the surface of foam carrier 40. With one suitable arrangement, laser-based processing techniques are used to form traces 38. Initially, powder coating equipment 54 may be used to deposit a powder coating onto the surface of foam carrier 40. Electrostatic power coating techniques may be used in which the power is attracted to the surface of carrier 40 by electrostatic attraction. The powder coating equipment may include a temporary metal insert (e.g., a metal rod or blade) that is inserted into the interior of foam carrier 40 to help charge foam carrier 40 and electrostatically attract the power to the outer surfaces of carrier 40. Baking equipment (e.g., an oven that raises the temperature of the powder-coated carrier to 150° C. for 15 minutes) may be used to form a smooth coating from the powder.

The powder that is used may be based on plastic particles and may include metal suitable for activation by laser light. As an example, the powder that is applied to the surface of carrier 40 may be a laser direct structuring powder (LDS powder) based on polyester particles with metal suitable for activation by application of laser light.

Following application of the powder to the surface of carrier 40, laser-based tool 56 may be used to selectively activate the surface of the powder for subsequent metal growth. Tool 56 may include a laser such as laser 58 that is positioned using computer-controlled positioner 60. By controlling the position of laser 58, laser light 62 may be applied in desired areas of LDS powder coating 64 on carrier 40. The application of laser light activates the coating in the exposed areas so that when carrier 40 is subjected to electroplating in plating tool 66, metal traces 38 will selectively grow in the activated areas and not in the areas that were not activated by application of the laser light. By depositing metal traces 38 in a pattern that is defined by the pattern of light 62 applied to coating 64 on carrier 40, desired patterns for antenna structures such as antenna resonating element 34 and antenna ground 36 can be formed.

Following formation of patterned traces 38 on carrier 40, soldering tool 68 (e.g., a reflow oven, a hot bar tool, or other soldering equipment) may be used to solder components 20, transmission lines 16, flexible printed circuits, wires, and other conductive structures to metal traces 38, thereby forming antenna 18. If desired, the traces on carrier 40 may be used for forming sensor structures such as proximity sensor structures (e.g., electrode structures formed from antenna traces or other traces). In this type of configuration, solder 42 may be used to couple signal lines for a proximity sensor control circuit or other external circuitry to the proximity sensor structures on carrier 40.

Figure 5:
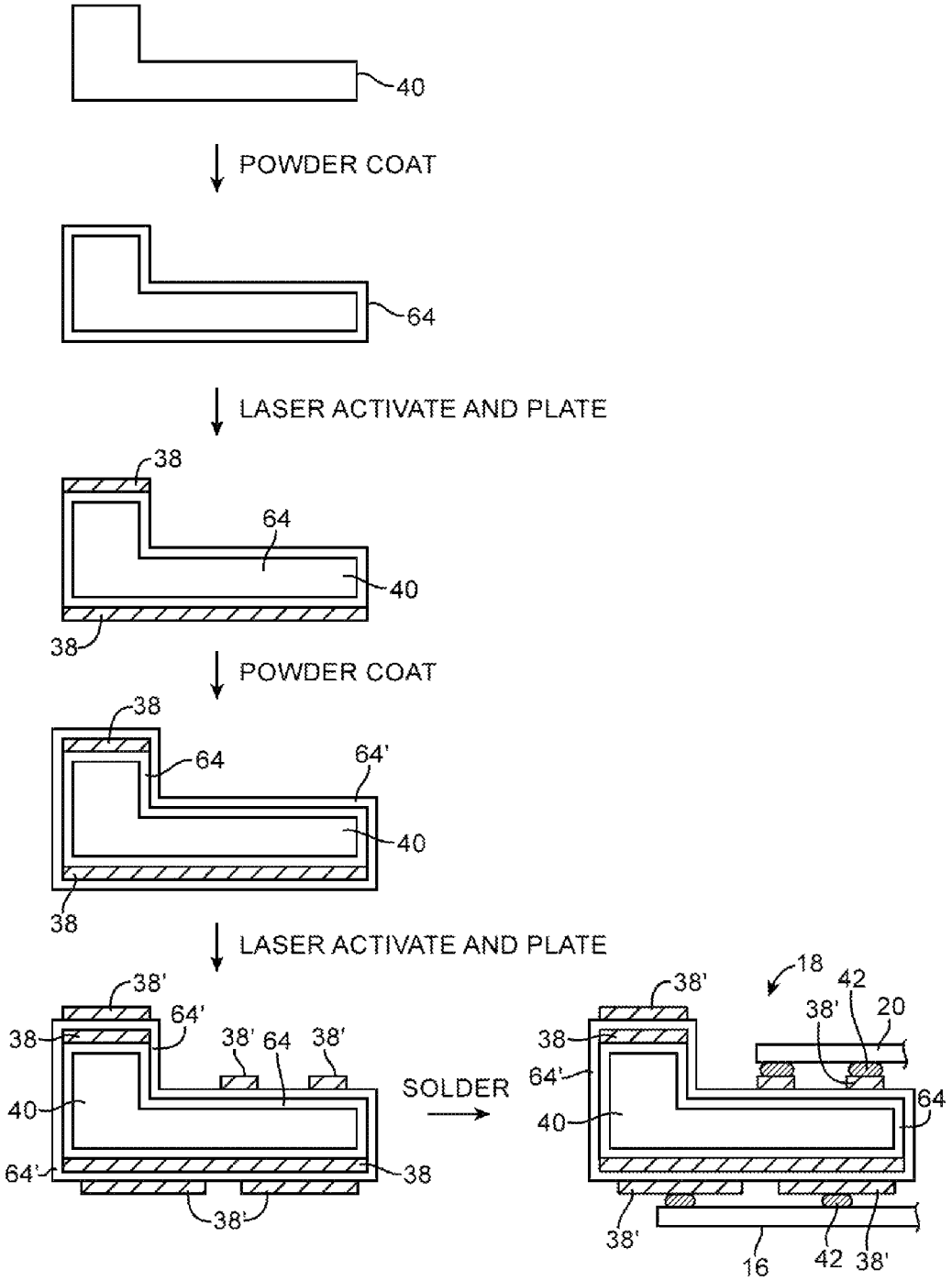
FIG. 5 is a diagram showing illustrative steps involved in forming antenna structures using laser-based processes in accordance with an embodiment of the present invention.

Laser-based processing techniques for forming metal traces 38 on carrier 40 for antenna 18 are illustrated in FIG. 5. Initially, carrier 40 is formed from a dielectric such as a polymer foam.

Following formation of foam carrier 40, an LDS powder such as powder 64 may be applied to carrier 40. Powder 64 may cover the exposed outer surfaces of carrier 40. An oven or other equipment may be used to elevate the temperature of powder 64 and carrier 40 sufficiently to form a smooth coating from powder 64 prior to application of laser light.

After forming baked powder coating 64 on carrier 40, laser equipment 56 can expose the surface of coating 64 to light in selected areas. Carrier 40 and its exposed coating 64 may then be placed in an electrochemical deposition tool (e.g., an electroplating bath). Areas of coating 64 that were not exposed to laser light 62 will not promote metal growth and will therefore remain bare of traces 38. Areas of coating 64 that were activated by exposure to laser light 62 will promote metal growth during plating operations and will therefore result in the formation of corresponding patterned areas of metal traces 38.

Multiple layers of metal traces may be formed using this type of laser-based processing technique. As shown in FIG. 5, for example, one or more additional coatings of powder 64 such as powder coating 64' may be deposited over previously deposited metal traces 38. Laser light may then be selectively applied to portions of the surface of coating 64' and the exposed coating 64' may be exposed to plating solution to grow an additional layer of patterned metal traces 38'. Soldering operations may then be performed to attach components 20, transmission line 16, and other circuitry, thereby forming antenna 18 of FIG. 5.

Figure 6:
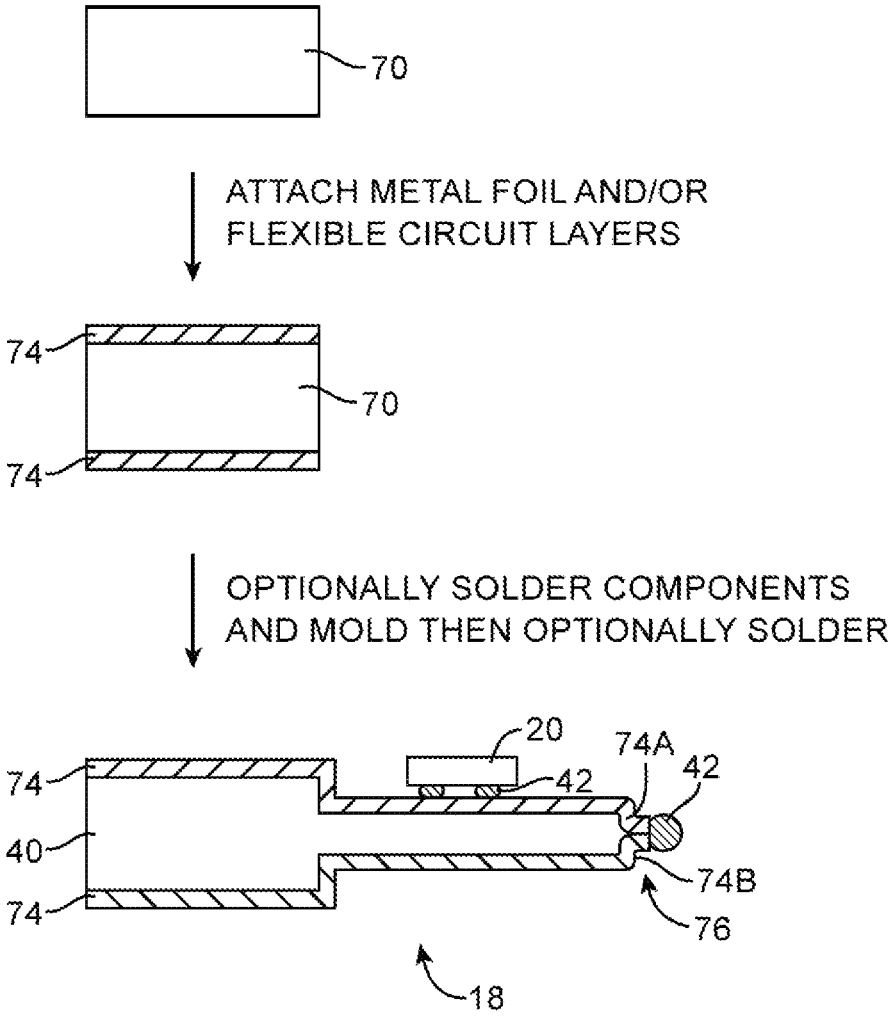
FIG. 6 is a diagram showing illustrative steps involved in forming antenna structures by attaching layers such as layers of metal foil or flexible printed circuit layers to a dielectric carrier in accordance with an embodiment of the present invention.

FIG. 6 shows how a foam carrier may be used to form an antenna in a scenario in which metal antenna traces are formed using a fabrication technique that does not rely on laser-based processing. As shown in FIG. 6, metal structures such as layers 74 may be attached to the surfaces of foam carrier material 70 (e.g., a foam block). Layers 74 may include unpatterned (blanket) metal foil layers or patterned metal foil. Layers 74 may also include one or more flexible printed circuits. A flexible printed circuit may be formed from a flexible polymer substrate such as a layer of polyimide or other sheet of polymer having one or more layers of substrate material and one or more layers of patterned metal traces (e.g., antenna traces). Layers 74 may be attached using adhesive or by heating foam material 70 while pressing layers 74 against foam material 70. Layers 74 may be applied using rollers, may be applied inside a heated mold, or may be applied using other techniques.

To shape foam 70 into a desired shape, foam 70 and layers 74 may be inserted into a mold cavity in a heated mold. Components 20 may be soldered to the metal of the foil or the metal of the metal traces using solder 42 before molding foam 70. After soldering any desired components 20 onto the metal on foam 70, the heated mold may be used to compress and shape foam 70 and layers 74 into a desired finished shape, thereby forming molded carrier 40 and layers 74 on the surface of carrier 40 for antenna 18. As shown in FIG. 6, there may be seams such as seam 76 at locations where the metal of layers 74 on the opposing upper and lower surfaces of carrier 40 is joined together. To form a satisfactory electrical connection between the joined layers at seam 76, a bead of solder 42 may be formed that runs along seam 76 (e.g., into the page in the orientation of FIG. 6). Solder 42 may be formed using soldering tool 68 (e.g., a reflow oven, a hot bar tool, etc.). As an example, solder paste may be applied along seam 76. Following application of the solder paste, an elevated temperature may be applied to reflow the solder paste and form solder 42 along seam 76.

Figure 7:
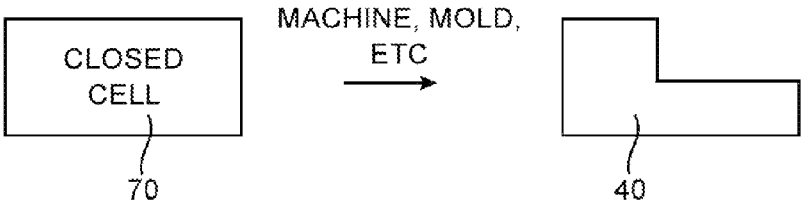
FIG. 7 is a diagram showing how an antenna carrier may be formed from a dielectric material such as closed cell foam in accordance with an embodiment of the present invention.

Carrier 40 may be formed from closed cell or open cell foam. In closed cell foam, the polymer that forms the foam surrounds and encloses individual foam gas bubbles. As shown in FIG. 7, closed cell foam 70 may be shaped into a desired carrier shape for carrier 40 using machining, molding, or other fabrication techniques. Because foam 70 in the FIG. 7 example is formed for a closed cell material, the surface of carrier 40 will generally be of sufficient smoothness to allow coating 64 to be deposited and laser processed to form patterned metal traces 38, as described in connection with FIG. 4.

Figure 8:
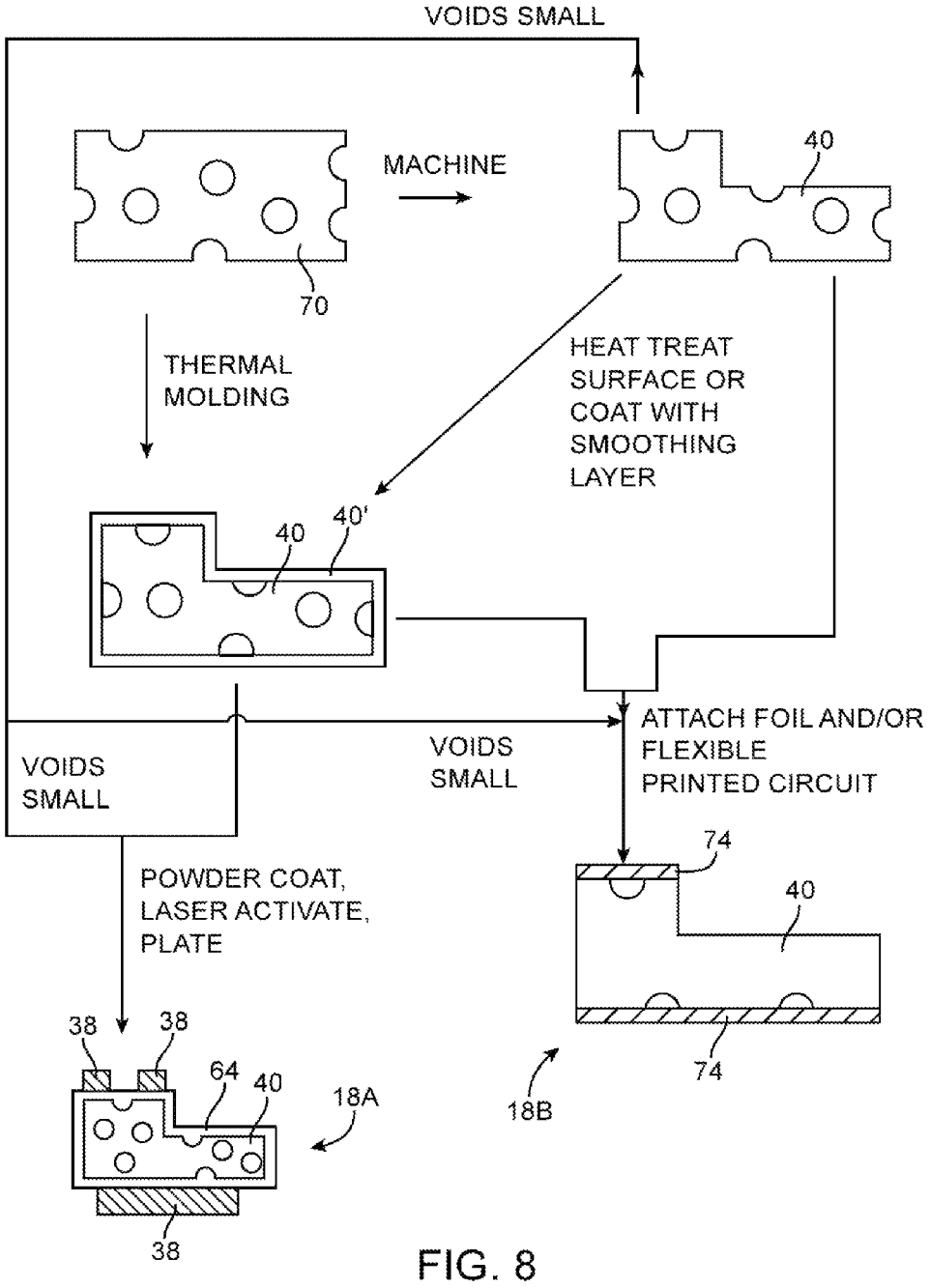
FIG. 8 is a diagram showing how an antenna may be formed from a dielectric material such as open cell foam in accordance with an embodiment of the present invention.

In open cell foam, individual gas bubbles in the foam are connected to each other, creating a potentially porous and rough surface following machining. Illustrative techniques suitable for forming antennas 18 from open cell foam are shown in FIG. 8. As shown in FIG. 8, foam 70 (e.g., open cell foam) may be machined to form open foam carrier structure 40. In situations in which the gas bubbles in the foam are sufficiently small, laser-based processing techniques of the type described in connection with FIG. 4 may be used to form patterned metal traces 38 directly on the machined surfaces of carrier 40. For example, powder coating 64 may be deposited followed by selective activation of desired areas with laser exposure and plating operations to form traces 38 in antenna structures 18A. If the gas bubbles are not sufficiently small or if additional smoothness is desired on the surface of carrier 40, carrier 40 may be coated with a smoothing layer (e.g., a layer of polymer such as epoxy or other material) or may be subjected to a heat treatment or other treatment to smooth the surface of carrier 40. Following application of a smoothing coating or heat treatment of the surface of carrier 40, carrier 40 will have a smooth outer layer such as outer layer 40'. Layer 40' may also be formed by heating foam 70 in a heated mold during molding of carrier 40 from foam 70.

Following formation of smooth coating 40' on carrier 40, carrier 40 may be processed using laser-based processing techniques of the type described in connection with FIG. 4. For example, powder coating 64 may be deposited followed by selective activation of desired areas with laser exposure and plating operations to form traces 38 in antenna structures 18A.

Coated carrier 40 (i.e., carrier 40' with smoothing coating 40') or carrier 40 formed by machining foam 70 without forming coating 40' may be used as a dielectric carrier for antenna structures 18B. Layers 74 of metal foil and/or flexible printed circuits may be attached to carrier 40 using adhesive, as part of a thermal molding process, or using other attachment mechanisms. Layers 74 may contain metal structures (e.g., patterned metal traces, ground plane structures, foil patterns, unpatterned regions of metal foil, etc.) for forming antenna 18B.

Following formation of antenna structures 18A or 18B of FIG. 8, components 20, transmission line 16, flexible printed circuits, and other circuitry can be attached using solder 42 to form antenna structures 18 for device 10.

The foregoing is merely illustrative of the principles of this invention and various modifications can be made by those skilled in the art without departing from the scope and spirit of the invention.

What is claimed is:

1. An antenna, comprising:

a foam carrier;

metal on the foam carrier;

a powder coating on the foam carrier, wherein the metal comprises metal traces on the powder coating;

solder on the metal; and an additional powder coating formed on the metal traces such that the metal traces are interposed between the powder coating and the additional powder coating.

2. The antenna defined in claim 1 wherein the foam carrier comprises open cell foam.

3. The antenna defined in claim 1 wherein the foam carrier comprises closed cell foam.

4. The antenna defined in claim 1 wherein the powder coating comprises laser-activated areas and wherein the metal traces comprises plated metal traces on the laser-activated areas.

5. A method of forming an antenna, comprising:

depositing a powder on a foam carrier;

after depositing the powder on the foam carrier, exposing the deposited powder to a temperature of more than 150° C.;

after exposing the deposited powder to the temperature of more than 150° C., selectively exposing areas of the powder to laser light; and plating metal onto the exposed areas following exposure of the areas to the laser light to form metal antenna traces on the foam carrier.

6. The method defined in claim 5 further comprising:

soldering at least one component to the metal antenna traces using solder.

7. The method defined in claim 6 wherein soldering the component comprises depositing solder paste and exposing the solder paste to a temperature of at least 200° C.

8. The method defined in claim 5 further comprising:

before depositing the powder on the foam carrier, inserting a metal insert into the interior of the foam carrier to charge the foam carrier.

9. The method defined in claim 5, wherein the powder comprises polymer particles and additional metal.

10. The method defined in claim 5, wherein the powder comprises laser direct structuring powder.

* * * * *